US006920743B2

(12) United States Patent
Harrison

(10) Patent No.: US 6,920,743 B2
(45) Date of Patent: Jul. 26, 2005

(54) ADJUSTABLE EQUINE SADDLE TREE

(76) Inventor: James Harrison, 1734 Martel Ave., Fort Worth, TX (US) 76103

( * ) Notice: Subject to any disclaimer, the term of this patent is extended or adjusted under 35 U.S.C. 154(b) by 0 days.

(21) Appl. No.: 10/266,254

(22) Filed: Oct. 8, 2002

(65) Prior Publication Data

US 2004/0065062 A1 Apr. 8, 2004

(51) Int. Cl.[7] ..... B68C 1/02; B68C 1/10; B68C 1/00

(52) U.S. Cl. ..... 54/44.7; 54/44.1; 54/44.4

(58) Field of Search ..... 54/44.1, 44.3, 54/44.4, 44.7

(56) References Cited

U.S. PATENT DOCUMENTS

| | | | | | |
|---|---|---|---|---|---|
| 121 | A | * | 2/1837 | Jones | 54/44.3 |
| 497,665 | A | * | 5/1893 | Hotze | 54/44.1 |
| 671,765 | A | * | 4/1901 | Hunter | 54/44.1 |
| 744,591 | A | * | 11/1903 | Moore | 54/44.4 |
| 1,155,465 | A | * | 10/1915 | Beal | 54/44.1 |
| 4,745,734 | A | * | 5/1988 | Brown | 54/44.7 |
| 5,018,340 | A | * | 5/1991 | Marshall | 54/44.7 |
| 5,274,986 | A | * | 1/1994 | Gonzales | 54/44.1 |
| 5,383,328 | A | * | 1/1995 | Brown | 54/44.3 |
| 5,497,602 | A | * | 3/1996 | Arnold | 54/44.7 |
| 5,884,459 | A | * | 3/1999 | Biddlecome | 54/44.1 |
| 6,044,630 | A | * | 4/2000 | Coffin | 54/44.4 |

FOREIGN PATENT DOCUMENTS

| | | | | |
|---|---|---|---|---|
| GB | 2239158 | A | * 6/1991 | B68C/1/04 |

* cited by examiner

*Primary Examiner*—Teri Pham Luu
*Assistant Examiner*—Elizabeth Shaw
(74) *Attorney, Agent, or Firm*—Sanford E. Warren, Jr.; E. E. "Jack"Richards, II; Winstead Sechrest & Minic P.C.

(57) ABSTRACT

A saddle tree whereby various parameters, such as the fork, cantle, seat length and various angles there between are readjustable to accommodate different animals (e.g., horses) as well as the same animal as its physical dimensions change. The saddle tree is rigid thereby alleviating certain discomforts for the animal and rider.

9 Claims, 3 Drawing Sheets

ADJUSTABLE EQUINE SADDLE TREE

FIELD OF THE INVENTION

This invention relates to the field of saddle trees for horses and, in particular, readjustable, rigid saddle trees.

BACKGROUND OF THE INVENTION

Early saddles lacked stirrups and thereby had several shortcomings. For example, with no stirrups, the rider had to use his hands to better stay on the horse. This hindered his ability to perform tasks such as hunting. In addition, the rider suffered discomfort when the horse galloped in that he could not effectively separate his groin area from the horse's back.

The introduction of stirrups helped alleviate some of the aforementioned problems in that the rider could more easily "brace" himself by exerting force on the stirrups. Consequently, his hands were more free to hunt or otherwise control the horse. Furthermore, he could "stand" in the stirrups to separate his mid-section from a galloping horse's back.

The introduction of the stirrup, however, required a rigid frame or "tree" for anchoring the stirrup straps. For example, in order for the rider to "stand" in a stirrup, the stirrup must be firmly anchored to a rigid frame.

The stirrups' need for a rigid tree made a close fit of the saddle to the horse a necessity. A rigid frame that fit poorly could create pressure points that, for example, may be areas of concentrated pressure where a small section of the frame presses down on the bone of the horse. The result could range from chaffing the horse to major sores at pressure points on the horse. Consequently, the goal became trying to ensure the weight of the rider or pack was supported by muscle tissue on the animal's back without applying direct pressure to bone.

Attempts to custom fit rigid trees to specific horses presented a problem in that the same tree could not be used for other horses of different dimensions. Furthermore, one rigid frame could not be used on horses, mules, ponies and asses because of their differing sizes and shapes. In addition, not only do different species and different individual animals within the same species vary in size and shape, an individual animal itself may have varying sizes and shapes according to changes in age and diet. Finally, the complications with rigid trees grew in that any rider that used multiple horses with different shapes and sizes would suffer undue expense because no one tree worked for all horses.

Accordingly, there have been continuing attempts to create a readjustable saddle tree. Prior efforts to provide an adjustable saddle that may comfortably fit a variety of horse shapes include U.S. Pat. Nos. 121 (Jones) and 5,383,328 (Brown). These patents disclose methods of adjusting saddle trees in a limited number of ways. The prior art does not suggest a saddle tree that provides a sufficient level of adjustability to work with animals and riders of different shapes and sizes. Nor does the prior art contemplate a tree that provides satisfactory rigidity so as to prevent discomfort for the horse and rider. The present invention addresses these limitations.

SUMMARY OF THE INVENTION

One example of the invention is an adjustable saddle tree that allows the user, using common hand tools, to adjust the widths of the fork and cantle as well as the length and height of the seat. Furthermore, the cantellete and pommel brace may be positioned in varying angles with respected to the tree's bars. Consequently, the tree is suitable for horses, mules, ponies and assess. Furthermore, riders of different sizes may use the invention as well due to the degree of adjustability in, for example, the seat. Another example of the invention entails a tree that is substantially rigid once it its placed in a "set" position.

The foregoing has outlined rather broadly the features of the present invention in order that the detailed description of the invention that follows may be better understood. Additional features and advantages of the invention will be described hereinafter which form the subject of the claims of the invention.

Glossary

Cantle/Cantelette: The back of the seat of the saddle. The part of the saddle which projects upwards toward the rear.

Fork: The raised, shaped part at the front of a saddle.

Pedestal: A saddle component that joins the cantle to the saddle.

Pommel: The wide uplifted front of the saddle (forming the fork in the western saddle).

Seat: The part of the saddle where the rider sits.

Stirrup: Each of a pair of devices attached at either side of a horse's saddle, in the form of a loop with a flat base to support the rider's foot.

Withers: Area above the horse's shoulder, where the neck meets the back.

BRIEF DESCRIPTION OF THE DRAWINGS

For a more complete understanding of the present invention, and the advantages thereof, reference is now made to the following description taken in conjunction with the accompanying drawings.

DETAILED DESCRIPTION OF THE DRAWINGS

Figure 3:
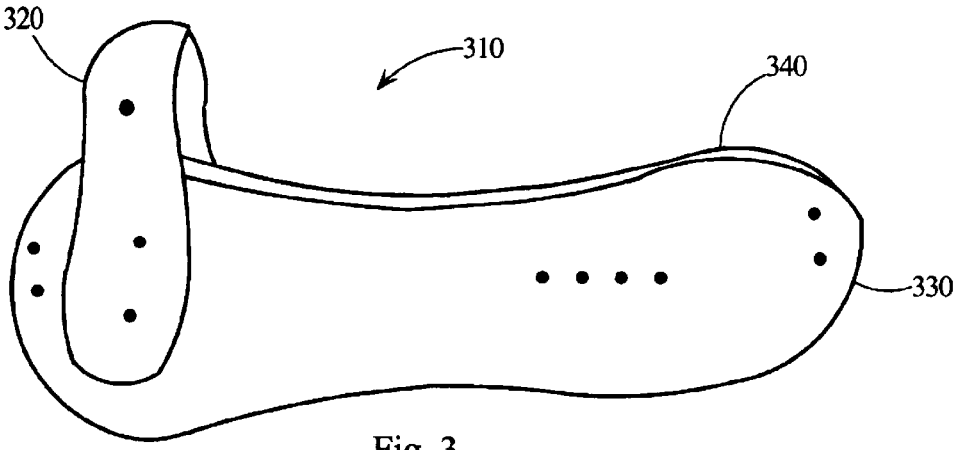
FIG. 3: Partially assembled tree with "pommel brace" affixed to the bars.
Figure 1:
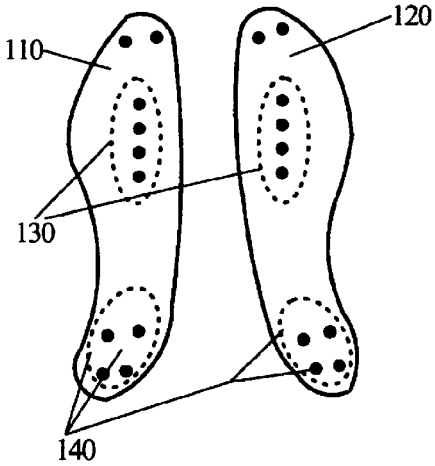
FIG. 1: Two lateral span pontoons known as "bars" with preset holes.
Figure 2:
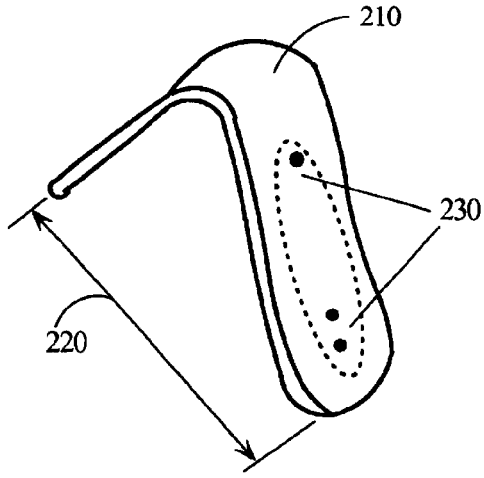
FIG. 2: Pommel brace with a possible 3–5 inch width at the fork.

FIG. 1 depicts one embodiment of the invention wherein left 120 and right 110 pontoons (or bars) are shown with preset holes 130 and 140. FIG. 2 depicts an example pommel brace 210 with preset holes 230 and, for example, a three to five inch distance at the fork 220 where the bars 120 and 110 approach the withers (bony formation) of the horse. FIG. 3 depicts an example of a partially assembled tree 310 with pommel brace 320 affixed to the front of the bars 330 and 340 via preset holes 140 (FIG. 1) and 230 (FIG. 2).

Figure 6:
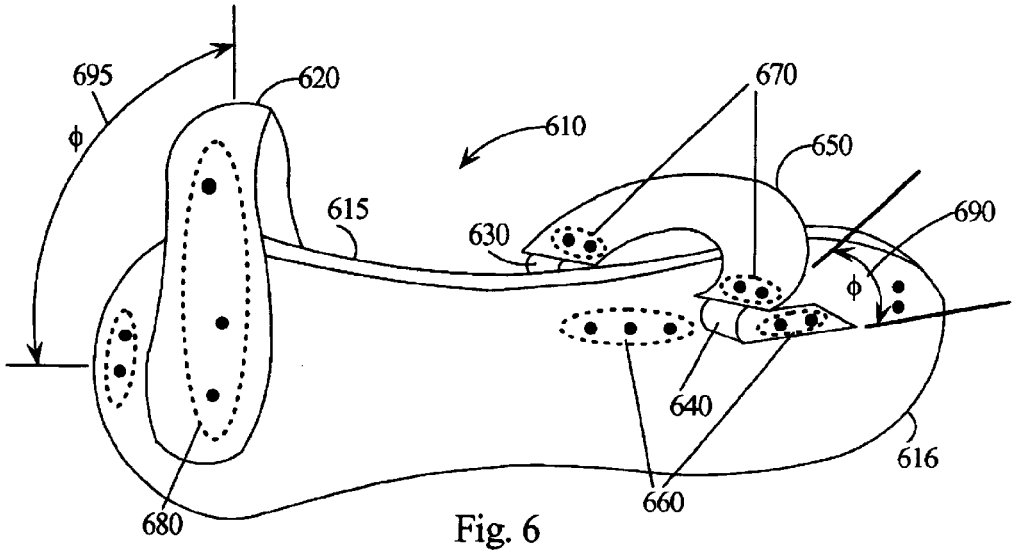
FIG. 6: Fully assembled tree with pommel brace, pedestals and cantelette installed.
Figure 4:
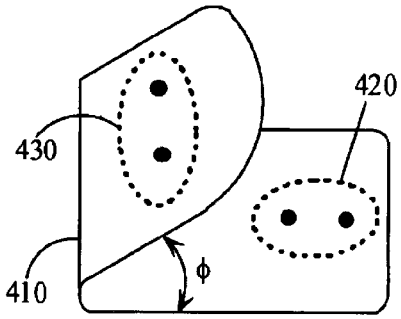
FIG. 4: Pedestal for coupling the cantelette to the bars.
Figure 5:
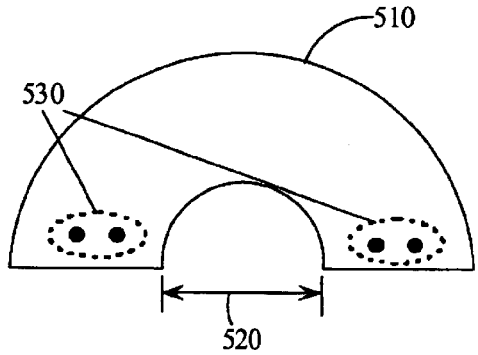
FIG. 5: Cantelette with a possible 7–10 inch width at the cantle.

FIG. 4 depicts an example of a "pedestal" 410 with preset holes 420, 430. FIG. 5 illustrates an example "cantelette" 510 with preset holes 530 and a varying width 520 of, for example, seven to ten inches. FIG. 6 depicts an example of a fully assembled tree 610 with pommel brace 620, pedestals 630, 640 and cantelette 650 installed.

In one embodiment of the invention, FIG. 6 illustrates how the seat length may be adjusted by positioning the pedestals 630, 640 in different positions along the line of preset holes 660, 420 (FIG. 4). A similar set of holes 140 (FIG. 1) at the pommel brace/bar junction also allow for various seat lengths. Also, the cantelette 650 can be raised or lowered by adjusting its position along a set of holes 670 in the catelette 650 and pedestals 630, 640. This adjustment can also affect the width of the cantle 520 in one embodiment of the invention (FIG. 5). The height of the pommel brace 620 can be adjusted using a set of holes 680 in the pommel brace 620 and bars 615, 616. This can also affect the width of the fork 220 (FIG. 2).

Also, in yet another embodiment of the invention, the angle 690 between the cantelette 650 and bars 615, 616 can be adjusted by using pedestals 630, 640 with different pre-formed angles 690. The angle that any saddle used with the tree 610 lies at is also affected by different positions used along holes 660, 670, 430, 420. In addition, the angle 695 between the pommel brace 620 and bar 615, 616 can be adjusted using different sets of preset holes 230, 140 in the pommel brace 620 or bars 615, 616.

Figure 7:
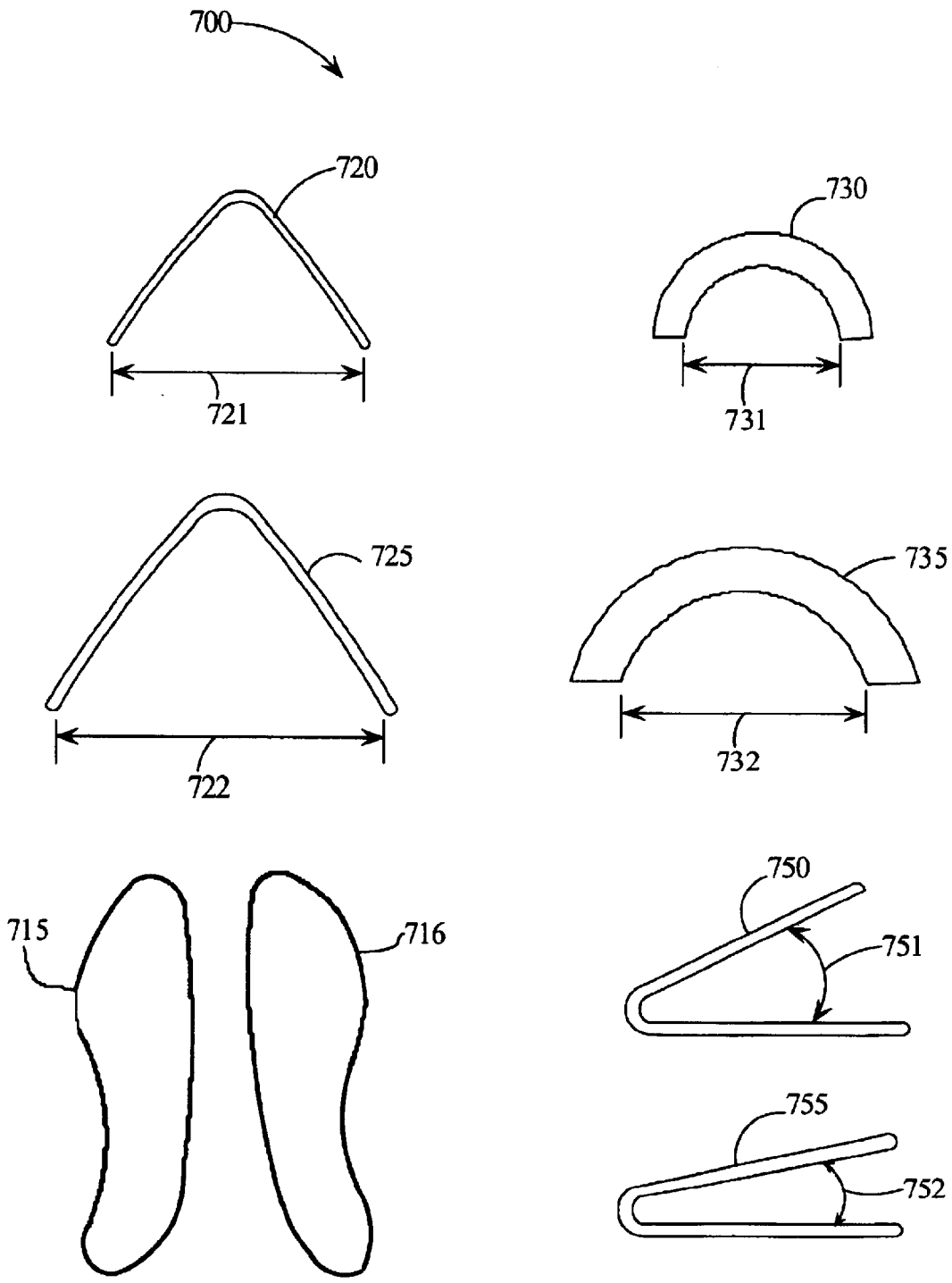
FIG. 7: Saddle tree kit.

In another example of the invention, pommel braces 620 and cantelettes 650 of varying preformed widths 220, 520 (FIGS. 2 and 5) are used to adjust cantle and fork widths. In one embodiment of the invention, various preformed pedestals 630, 640 are also an option for further customization of cantle width 520. Using preformed pommel braces and cantelettes of varying widths allows for a large degree of adjustability in the tree while still ensuring the tree remains substantially rigid in its "set" position (i.e., adjusted to size). FIG. 7 illustrates one example a saddle tree kit 700. The kit 700 may have a plurality of pommel braces 720, 725 with a plurality of widths 721, 722. The kit 700 may also have a plurality of cantelettes 730, 735 with a plurality of widths 731, 732. The kit 700 may further include bars 715, 716. Further still, the kit 700 may include a plurality of pedestals 750, 755 with a plurality of angles 751, 752. Much of the prior art uses hinges and springs to acquire this same level of adjustability only to sacrifice rigidity and consequently performance. A rigid tree should flex minimally with the movement of the horse.

Alternative embodiments of the invention may substitute slots for any of the aforementioned groups of preset holes. A coupling device such as a nut and bolt will enable the rider to fix the tree in a larger number of positions than would be possible with preset holes. The rigidity of the tree could be ensured by using an element such as Loctite on the bolts. Also, various materials can be used in constructing the tree including, for example, polynylon, titanium steel alloy, carbon steel and aluminum alloy.

FIGS. 1–6 depict a "Forward Seat" or "English" model but the invention may also be suitable for the "Mexican", "American Western" or other saddle models. Furthermore, the invention is suitable for, as an example, horses, asses, ponies and mules.

All patents referenced herein are hereby incorporated by reference. It will be understood that certain of the above-described structures, functions and operations of the above-described preferred embodiments are not necessary to practice the present invention and are included in the description simply for completeness of an example embodiment or embodiments. In addition, it will be understood that specific structures, functions and operations set forth in the above-referenced patents can be practiced in conjunction with the present invention, but they are not essential to its practice. It is therefore to be understood that within the scope of the claims, the invention may be practiced otherwise than as specifically described without actually departing from the spirit and scope of the present invention.

What is claimed is:

1. A saddle tree comprising:

a plurality of support members;

a first cross member;

a second cross member; and a means for coupling the cross members to the support members;

wherein the distance between the support members and the distance between the cross members is readjustable;

further wherein the angle between the support members and the first cross member is readjustable.

2. A saddle tree comprising:

a plurality of support members;

a first cross member;

a second cross member; and a means for coupling the cross members to the support members;

wherein the distance between the support members and the distance between the cross members is readjustable;

further wherein the angle between the support members and the second cross member is readjustable.

3. A saddle tree comprising:

a plurality of support members;

a first cross member;

a second cross member; and a means for coupling the cross members to the support members;

wherein the distance between the support members and the distance between the cross members is readjustable;

further wherein the tree may be set in a substantially rigid state.

4. A saddle tree comprising:

a plurality of support members;

a first cross member;

a second cross member; and a means for coupling the cross members to the support members;

wherein the distance between the support members and the distance between the cross members is readjustable;

further wherein the height of at least one cross member is readjustable.

5. A saddle tree comprising:

a plurality of support members;

a first cross member;

a second cross member; and a means for coupling the cross members to the support members;

wherein the distance between the support members and the distance between the cross members is readjustable:

further wherein the distance between the cross members is readjustable by more than 1.5 inches.

6. A saddle tree kit comprising:

a plurality of fore cross members;

a plurality of aft cross members;

a plurality of support members; and a means for coupling the fore cross members and aft cross members to the support members;

wherein the distance between the support members and the distance between the cross members is readjustable;

further wherein the angle between the support members and the fore cross members is readjustable.

7. A saddle tree kit comprising:

a plurality of fore cross members;

a plurality of aft cross members;

a plurality of support members; and a means for coupling the fore cross members and aft cross members to the support members;

wherein the distance between the support members and the distance between the cross members is readjustable;

further wherein the angle between the support members and the aft cross members is readjustable.

8. A saddle tree kit comprising:

a plurality of fore cross members;

a plurality of aft cross members;

a plurality of support members; and a means for coupling the fore cross members and aft cross members to the support members;

wherein the distance between the support members and the distance between the cross members is readjustable;

further wherein the tree may be set in a substantially rigid state.

9. A saddle tree kit comprising:

a plurality of fore cross members;

a plurality of aft cross members;

a plurality of support members; and a means for coupling the fore cross members and aft cross members to the support members;

wherein the distance between the support members and the distance between the cross members is readjustable;

further wherein the height of the cross members is readjustable.

* * * * *